US008186324B2

(12) United States Patent
Iwata

(10) Patent No.: US 8,186,324 B2
(45) Date of Patent: May 29, 2012

(54) RESIN INTAKE APPARATUS

(75) Inventor: Shinji Iwata, Obu (JP)

(73) Assignee: Aisan Kogyo Kabushiki Kaisha, Obu-shi (JP)

( * ) Notice: Subject to any disclaimer, the term of this patent is extended or adjusted under 35 U.S.C. 154(b) by 727 days.

(21) Appl. No.: 12/285,610

(22) Filed: Oct. 9, 2008

(65) Prior Publication Data

US 2009/0133659 A1 May 28, 2009

(30) Foreign Application Priority Data

Nov. 23, 2007 (JP) ..... 2007-303791

(51) Int. Cl.
*F02M 35/10* (2006.01)

(52) U.S. Cl. ..... 123/184.61; 123/184.36; 123/184.21; 123/184.24; 123/184.51; 123/337

(58) Field of Classification Search ..... 123/184.36, 123/184.61, 337, 184.55, 184.21, 184.24, 123/184.51
See application file for complete search history.

(56) References Cited

U.S. PATENT DOCUMENTS 5,347,967 A * 9/1994 Todero et al. ..... 123/317
6,062,928 A * 5/2000 Watanabe et al. ..... 440/88 R
6,368,448 B1 * 4/2002 Okamura et al. ..... 156/274.2
6,427,655 B2 * 8/2002 Itoh et al. ..... 123/184.42
6,604,506 B2 * 8/2003 Tanaka et al. ..... 123/336
6,988,478 B2 * 1/2006 Tanikawa et al. ..... 123/184.42
2001/0032600 A1 * 10/2001 Minegishi et al. ..... 123/41.1
2001/0047802 A1 * 12/2001 Itoh ..... 123/585
2003/0041833 A1 * 3/2003 Carpenter ..... 123/184.61
2004/0194750 A1 * 10/2004 Tanikawa et al. ..... 123/184.42

FOREIGN PATENT DOCUMENTS

JP A-07-189643 7/1995
JP A-08-135530 5/1996
JP 2000087816 A * 3/2000
JP A-2000-087816 3/2000
JP A-2001-140713 5/2001
JP A-2005-226476 8/2005

OTHER PUBLICATIONS

English Translation of JP2000087816A.*
Japanese Office Action in Japanese Patent Application No. 2007-303791; dated Mar. 8, 2011 (with English-language translation).

* cited by examiner

*Primary Examiner* — Noah Kamen
*Assistant Examiner* — Long T Tran
(74) *Attorney, Agent, or Firm* — Oliff & Berridge, PLC

(57) ABSTRACT

A resin molded body constituting a resin intake apparatus includes a surge tank and a plurality of branch passages each branching off from the surge tank. A communication passage is formed in a wall forming the surge tank to communicate a bottom of the surge tank with one of the branch passages. The resin molded body is formed by two split molded parts integrally welded to each other at welded portions so that the communication passage is formed between the welded portions.

9 Claims, 5 Drawing Sheets

RESIN INTAKE APPARATUS

CROSS-REFERENCE TO RELATED APPLICATIONS

This application is based upon and claims the benefit of priority from the prior Japanese Patent Application No. 2007-303791 filed on Nov. 23, 2007, the entire contents of which are incorporated herein by reference.

BACKGROUND OF THE INVENTION

1. Field of the Invention

The present invention relates to an intake apparatus to be used for an engine and, more particularly, to a resin intake apparatus molded from resin.

2. Description of Related Art

As a technique of this type, heretofore, there have been known an intake apparatus and others disclosed in JP2000-87816A, JP8-135530(1996)A, and JP2005-226476A. In particular, a resin intake apparatus disclosed in JP'816A includes a surge tank, a plurality of branch passages each branching off from the surge tank, a blow-by gas introduction port, and a drain passage at the bottom of the surge tank and right under the blow-by gas introduction port, the drain passage communicating with the surge tank and a specific one branch passage respectively. This apparatus is arranged to allow oil mist in blow-by gas to flow from the drain passage to one branch passage.

Meanwhile, the intake apparatus disclosed in JP'816A needs additional works to increase the thickness of a portion for forming the drain passage therein and make a hole in the portion. Thus, yield of resin material is poor. When the intake apparatus is to be molded, the surge tank is likely to be limited in shape by the drain passage.

BRIEF SUMMARY OF THE INVENTION

The present invention has been made in view of the above circumstances and has an object to provide a resin intake apparatus with a communication passage formed without needing an additional increase in thickness of a portion for the communication passage and a surge tank having a shape unlimited by the communication passage.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a resin intake apparatus comprising: a resin molded body including a surge tank and a plurality of branch passages each branching off from the surge tank, wherein the surge tank is formed of a wall and has a bottom, and a communication passage is formed in the wall of the surge tank to communicate the bottom of the surge tank with one of the branch passages.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

<First Embodiment>

A detailed description of a preferred embodiment of a resin intake apparatus embodying the present invention will now be given referring to the accompanying drawings.

Figure 1:
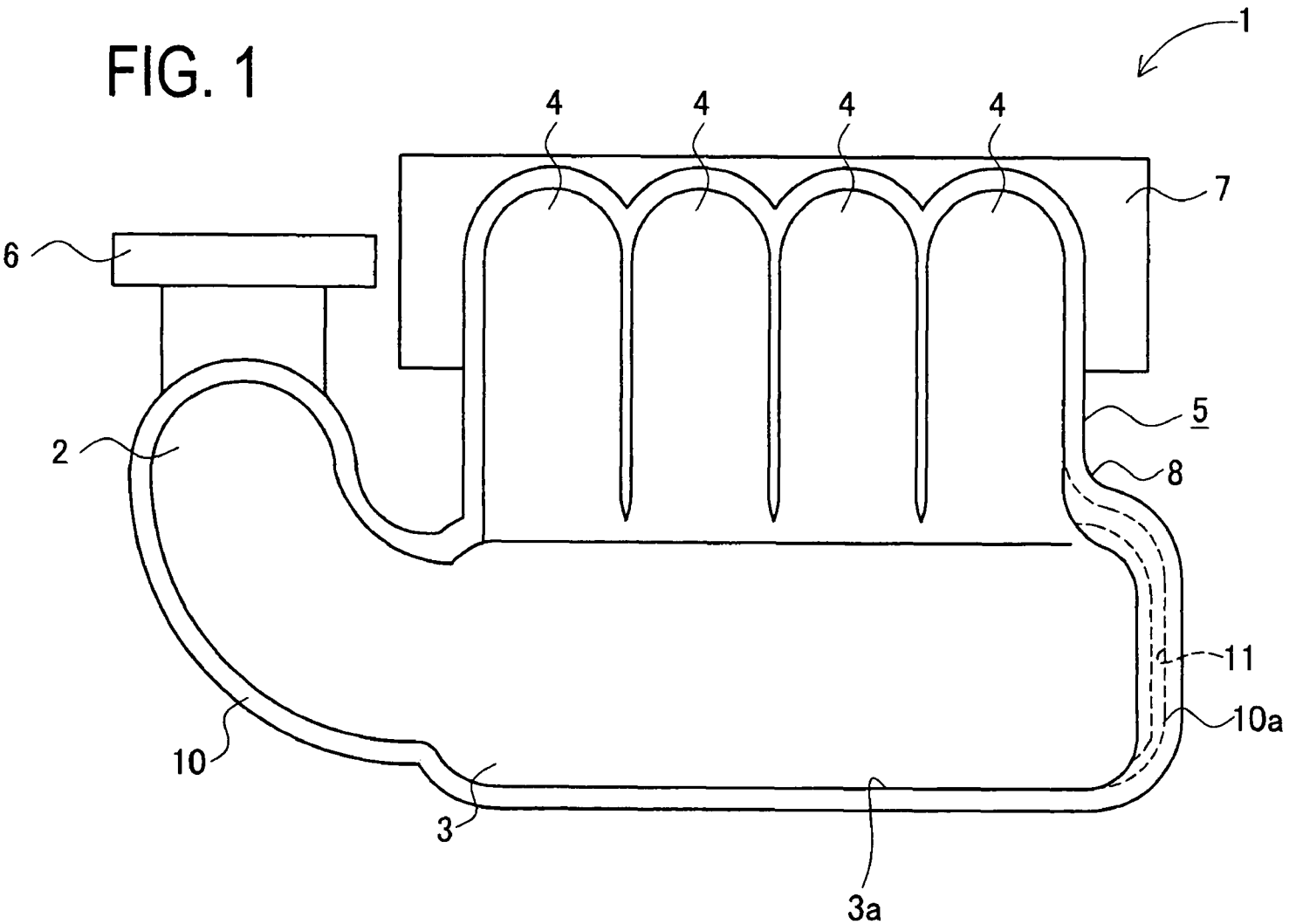
FIG. 1 is a front view of a resin intake apparatus in a first embodiment.
Figure 2:
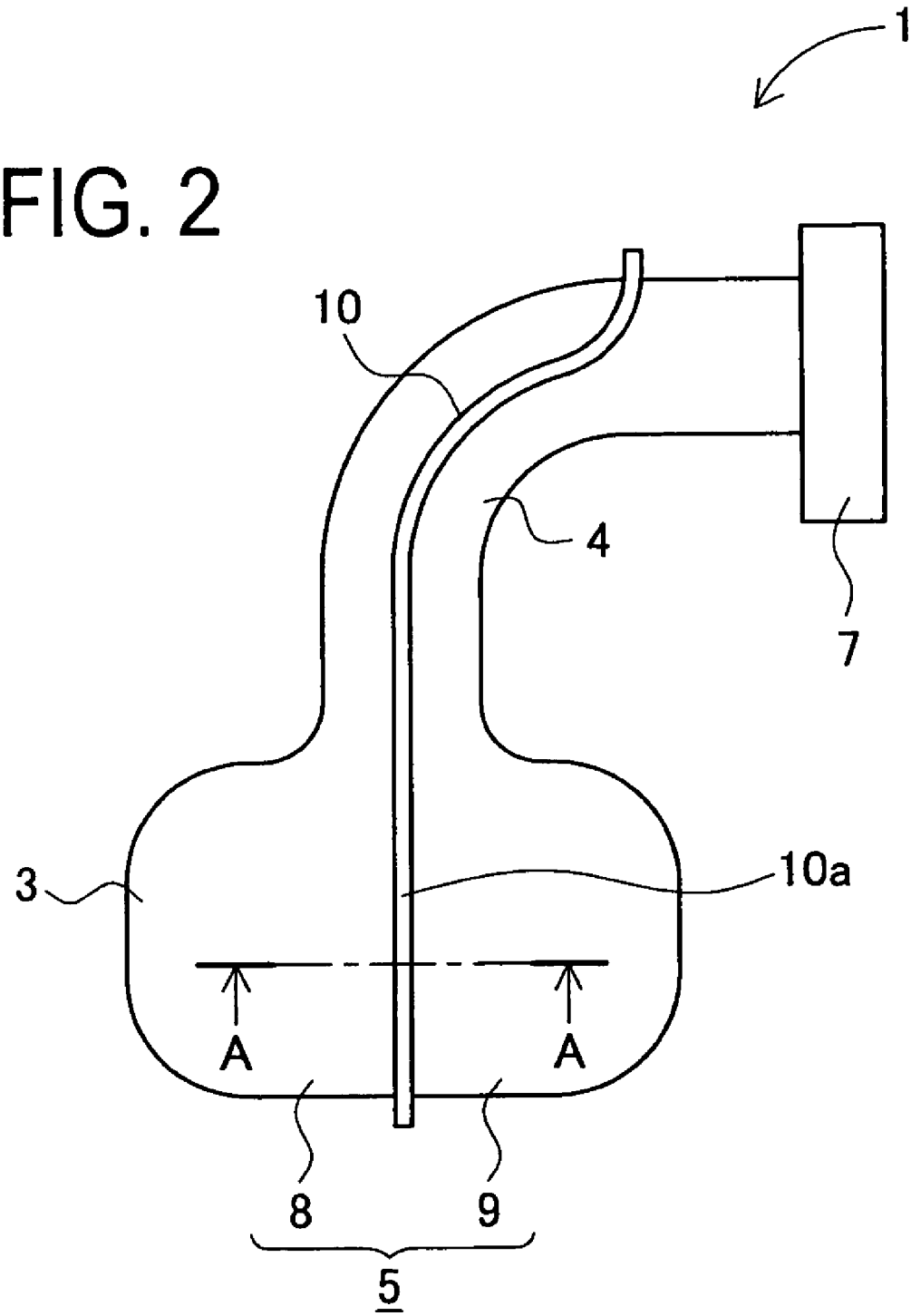
FIG. 2 is a right side view of the resin intake apparatus of FIG. 1 in the first embodiment.

FIG. 1 is a front view of a resin intake apparatus (hereinafter, simply referred to as an "intake apparatus") 1. FIG. 2 is a right side view of the intake apparatus 1. This intake apparatus 1 is constituted of a resin molded body 5 including an introduction passage 2, a surge tank 3 communicating with the introduction passage 2, and a plurality of branch passages 4 each branching off from the surge tank 3. This intake apparatus 1 has the shape for a four-cylinder engine and includes four branch passages 4. As shown in FIG. 1, a flange 6 which can be connected to an intake pipe is formed at an inlet side of the introduction passage 2. A flange 7 which can be connected to an intake port of the engine is formed at an outlet side of each branch passage 4. In this embodiment, the intake apparatus 1 with the surge tank 3 being located on the lower side as shown in FIGS. 1 and 2 will be attached to the engine. Accordingly, oil mist such as water or oil may collect in a bottom 3*a* of the surge tank 3.

The aforementioned resin molded body 5 is formed by two split molded parts (first and second split molded parts) 8 and 9 integrally welded to each other at respective welded portions 10 as shown in FIG. 2. As shown in FIG. 1, the welded portion 10 of each of the split molded parts 8 and 9 is formed of a rib extending like a flange along the periphery of the surge tank 3 and the branch passages 4. In FIG. 1, a welded portion 10*a* existing on the right of the resin molded body 5 has a slightly wider width than other portions of each welded portion 10. In this welded portion 10*a*, a communication passage 11 is formed to communicate the bottom 3*a* of the surge tank 3 with one of the branch passages 4. The welded portion 10*a* forms a part of the wall constituting the surge tank 3 and hence the communication passage 11 is formed in the wall of the surge tank 3.

Figure 3:
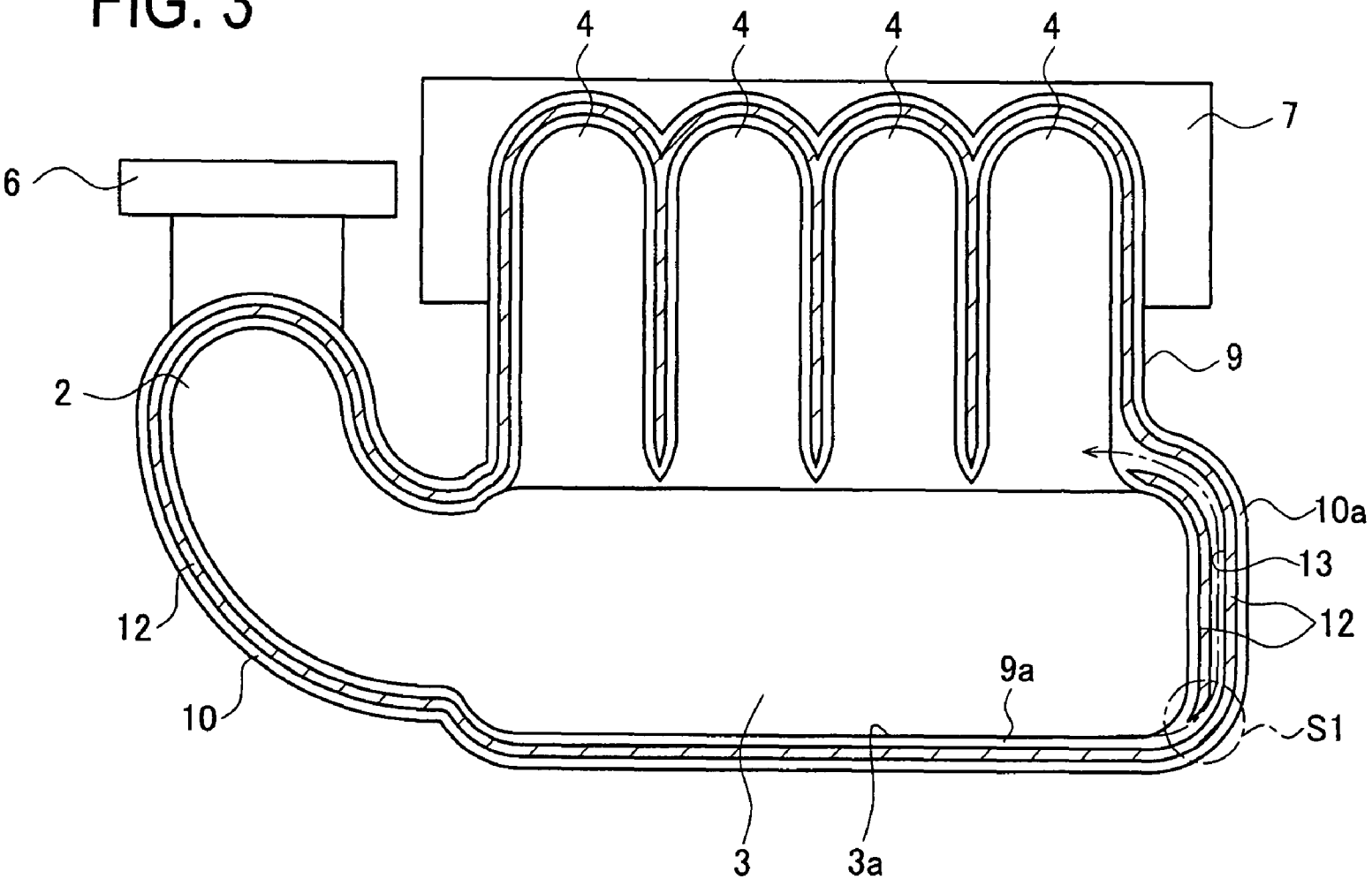
FIG. 3 is a front view of a second split molded part in the first embodiment, showing a state where a first split molded part is not yet welded thereto.
Figure 4:
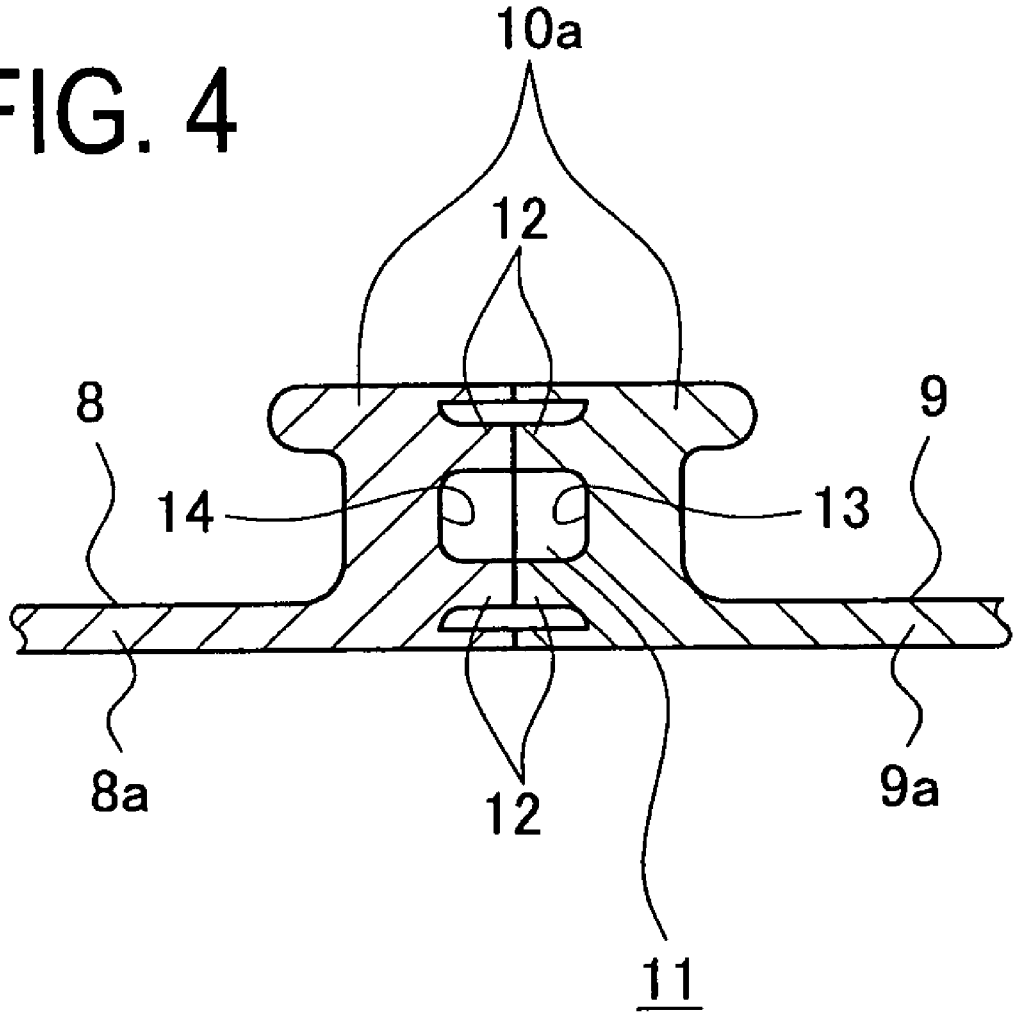
FIG. 4 is an enlarged sectional view of the resin intake apparatus in the first embodiment, taken along a line A-A in FIG. 2.

FIG. 3 is a front view of the second split molded part 9, which is a right one in FIG. 2, in a state where the first split molded part 8, which is a left one in FIG. 2, is not yet welded thereto. FIG. 4 is an enlarged sectional view of the intake apparatus 1 taken along a line A-A in FIG. 2. The welded portion 10 is formed at the edge of a wall 9*a* constituting this second split molded part 9. Along the entire circumference of the welded portion 10, a bead 12 (indicated by hatching) for welding is formed. The welded portion 10 has a flat welding surface on which the bead 12 is formed. The welded portion 10 is also formed at the edge of a wall 8*a* constituting the first split molded part 8. On this welded portion 10, similarly, a bead 12 is formed (see FIG. 4). For integrally assembling the resin molded body 5 from the two first and second split molded parts 8 and 9, these split molded parts 9 and 8 are subjected to vibration welding with respective beads 12 of the welded portions 10 abutting on each other.

As shown in FIGS. 3 and 4, the right welded portion 10*a* of the surge tank 3 of the second split molded part 9 is formed with a passage groove 13 for the communication passage 11 to communicate the bottom 3*a* of the surge tank 3 with one of the branch passages 4. The passage groove 13 is formed or defined between the beads 12 arranged in two rows over a predetermined length as shown in FIG. 3. The passage groove 13 is provided to extend upward from the bottom 3*a* of the surge tank 3 as shown in FIG. 3. The passage groove 13 has a sectional area determined 10 to be smallest in a portion indicated by a dashed line circle S1 in FIG. 3, located close to the bottom 3*a* of the surge tank 3, than other portions. The first split molded part 8 is similarly formed with a passage groove 14 corresponding to the passage groove 13 as shown in FIG. 4. Those passage grooves 13 and 14 constitute the communication passage 11 extending upward from the bottom 3*a* of the surge tank 3 and having a sectional area determined to be smallest in the portion close to the bottom 3*a* of the surge tank 3 than other portions.

The resin intake apparatus 1 in this embodiment described above will be mounted and used in an engine. During operation of the engine, air introduced into the surge tank 3 through the introduction passage 2 and then allowed to flow from the surge tank 3 to each branch passage 4 is taken into the engine. At that time, oil mist collected in the bottom 3*a* of the surge tank 3 will be sucked from the bottom 3*a* into the branch passages 4 through the communication passage 11 as indicated by an arrow in FIG. 3. Thus, the oil mist collected in the surge tank 3 will flow to the engine and be removed. Herein, the communication passage 11 is formed in the walls 8*a* and 9*a* of the split molded parts 8 and 9 constituting the surge tank 3, that is, in the welded portions 10*a*. Accordingly, there is no need for additional works to increase the thickness of or make a hole in the outside of the walls 8*a* and 9*a* constituting the surge tank 3 for forming the communication passage 11, so that the surge tank 3 is not limited in shape by the communication passage 11. As a result, the intake apparatus 1 can be manufactured at low cost without spoiling the external appearance of the surge tank 3.

In this embodiment, the communication passage 11 is formed between the welded portions 10*a* of the split molded parts 8 and 9 constituting the resin molded body 5. Accordingly, the communication passage 11 can be positioned on the flat welding surfaces of the welded portions 10*a* and thus the communication passage 11 needs to have no draft angle for a molding die and provides less limitation in design. Therefore there is less limitation in resin molding of the intake apparatus 1, thereby enabling formation of the communication passage 11 curved along the welded portion 10*a*.

In this embodiment, furthermore, negative pressure can be generated in an entrance of the communication passage 11 close to the bottom 3*a* of the surge tank 3. This negative pressure can cause the oil mist collected in the surge tank 3 to rapidly flow toward the branch passages 4. In other words, discharge of oil mist from the surge tank 3 can be promoted.

<Second Embodiment>

A second embodiment of the resin intake apparatus of the invention will be explained below referring to an accompanying drawing. Similar or identical parts in this embodiment to those in the first embodiment are given the same reference signs without repeating the details thereof. The following explanation is therefore made with a focus on differences from the first embodiment.

Figure 5:
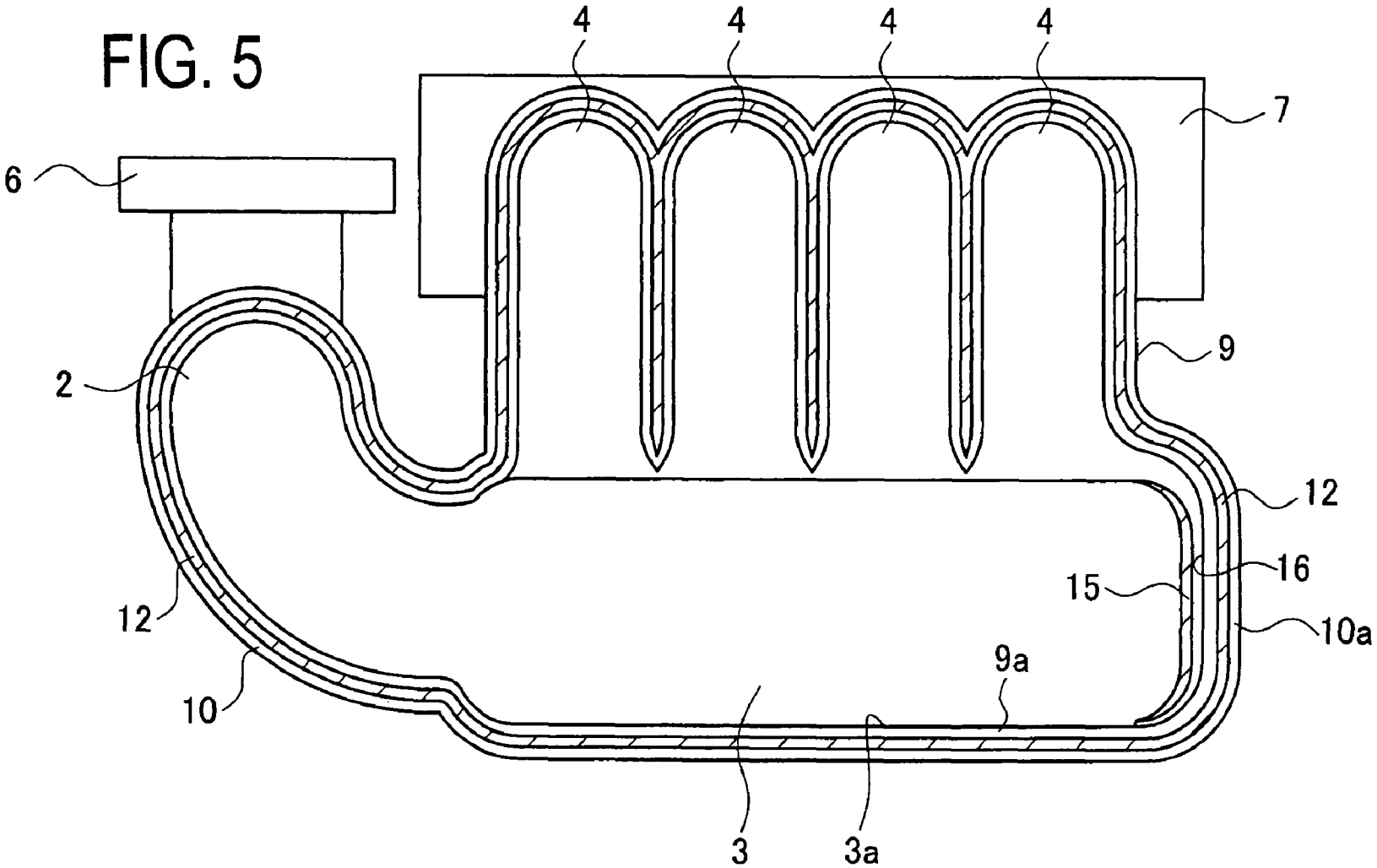
FIG. 5 is a front view of a second split molded part in a second embodiment, showing a state where a first split molded part is not yet welded thereto, corresponding to FIG. 3.

FIG. 5 is a front view of a second split molded part 9 not yet welded, corresponding to a state in FIG. 3. This embodiment differs from the first embodiment in that a communication passage is formed in the wall 9*a* of the split molded part 9 constituting the surge tank 3 so as to be located inside than the welded portion 10*a*, not formed in the welded portion 10*a*. In FIG. 5, specifically, a right portion of the wall 9*a* of the surge tank 3 is formed with a protrusion 15 along the welded portion 10*a* to provide a passage groove 16 between the protrusion 15 and the welded portion 10*a*. An end face of the protrusion 15 forms a bead 12 for welding. This protrusion 15 forms a part of the wall 9*a* of the split molded part 9. The protrusion 15 and the passage groove 16 are molded with a die that can provide a portion corresponding to the passage groove 16 from the wall 9*a*. The first split molded part 8 is identical in configuration of the protrusion 15 and the passage grove 16 to the second split molded part 9. The two split molded parts 8*a* and 9 are welded at the welded portions 10*a*, so that the communication passage (not shown) is formed to extend upward from the bottom 3*a* of the surge tank 3 and have a sectional area determined to be smallest in a portion close to the bottom 3*a* of the surge tank 3 than other portions.

In the resin intake apparatus 1 in this embodiment, similar to the first embodiment, the communication passage is formed in the wall constituting the surge tank 3. Accordingly, there is no need for additional works to increase the thickness of or make a hole in the outside of the wall of the surge tank 3. This makes it possible to eliminate an additional increase in thickness for a communication passage and design the shape of the surge tank 3 without limitation by the communication passage. Consequently, the intake apparatus 1 can be manufactured at low cost without spoiling the external appearance of the surge tank 3. Other operations and advantages are the same as those in the first embodiment.

The present invention is not limited to the above embodiment(s) and may be embodied in other specific forms without departing from the essential characteristics thereof. For instance, For instance, in each of the aforementioned embodiments, the resin intake apparatus 1 is provided with four branch passages 4 having a shape corresponding to a four-cylinder engine. The shape of the resin intake apparatus and the number of branch passages may be changed appropriately for the number of cylinders and the type of an engine.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A resin intake apparatus comprising:

a resin molded body including a surge tank and a plurality of branch passages each branching off from the surge tank, wherein the surge tank is formed of a wall and has a bottom, a communication passage is formed in the wall of the surge tank to communicate the bottom of the surge tank with a portion close to an entrance of one of the branch passages, and the communication passage is placed to extend upward from the bottom of the surge tank and have a sectional area determined to be smaller in a portion closer to the bottom of the surge tank than other portions.

2. The resin intake apparatus according to claim 1, wherein the resin molded body is formed by a plurality of split molded parts integrally welded to each other at welded portions so that the communication passage is formed between the welded portions.

3. The resin intake apparatus according to claim 2, wherein the welded portions are formed as a rib extending in a flange shape along an outer periphery of the surge tank and the branch passages.

4. The resin intake apparatus according to claim 3, wherein each of the welded portions has a flat welding surface on which a bead is formed along an entire circumference of the welded portion, and the resin molded body is formed by the plurality of split molded parts integrally vibration-welded to each other at the welded portions with the beads abutting on each other.

5. The resin intake apparatus according to claim 3, wherein each of the welded portions has a flat welding surface on which a bead is formed along an entire circumference of the welded portion, and a passage groove for the communication passage is formed in each welded portion, the passage groove is formed between the beads arranged in two rows over a predetermined length, and the resin molded body and the communication passage are formed by the plurality of split molded parts vibration-welded to each other at the welded portions with the beads abutting on each other.

6. A resin intake apparatus comprising:

a resin molded body including a surge tank and a plurality of branch passages each branching off from the surge tank, wherein the resin molded body is formed by two split molded parts welded to each other at welded portions, the surge tank is formed of a wall and has a bottom, a communication passage is formed in the wall of the surge tank, between the welded portions, to communicate the bottom of the surge tank with a portion close to an entrance of one of the branch passages, and the communication passage is placed to extend upward from the bottom of the surge tank and have a sectional area determined to be smaller in a portion closer to the bottom of the surge tank than other portions.

7. The resin intake apparatus according to claim 1, wherein the resin molded body is formed by a plurality of split molded parts integrally welded to each other at welded portions so that the communication passage is formed between the welded portions, and the communication passage is formed in the walls of the split molded parts and located inside than the welded portion.

8. The resin intake apparatus according to claim 7, wherein each of the welded portions has a flat welding surface, a bead is formed on each flat welding surface along an entire circumference of each welded portion, a protrusion is formed in part of each welded portion to extend along the welded portion, a passage groove is formed between the protrusion and the welded portion, and an end face of each protrusion forms a bead for welding, and the resin molded body and the communication passage are formed by the plurality of split molded parts vibration-welded to each other at the welded portions and the protrusions with the beads abutting on each other.

9. A resin intake apparatus comprising:

a resin molded body including a surge tank and a plurality of branch passages each branching off from the surge tank, wherein the resin molded body is formed by welding of two split molded parts each including a welded portion, the surge tank is formed of a wall and has a bottom, a communication passage is formed in the wall of the surge tank, inside than the welded portion, to communicate the bottom of the surge tank with a portion close to an entrance of one of the branch passages, the communication passage is placed to extend upward from the bottom of the surge tank and have a sectional area determined to be smaller in a portion closer to the bottom of the surge tank than other portions, each of the welded portions has a flat welding surface, a bead is formed on each flat welding surface along an entire circumference of each welded portion, a protrusion is formed in part of each welded portion to extend along the welded portion, a passage groove is formed between the protrusion and the welded portion, and an end face of each protrusion forms a bead for welding, and the resin molded body and the communication passage are formed by the two split molded parts vibration-welded to each other at the welded portions and the protrusions with the beads abutting on each other.

* * * * *